US005324124A

United States Patent [19]

Bayerle et al.

[11] Patent Number: 5,324,124

[45] Date of Patent: Jun. 28, 1994

[54] GUIDE SYSTEM FOR FEED ROLL ENTRY

[75] Inventors: Peter A. Bayerle, Lexington, Ky.; Jeffrey H. Paterra, Vestal, N.Y.

[73] Assignee: International Business Machines Corporation, Armonk, N.Y.

[21] Appl. No.: 10,112

[22] Filed: Jan. 28, 1993

[51] Int. Cl.[5] ..... B41J 13/02

[52] U.S. Cl. ..... 400/636; 271/198; 271/226; 271/229; 226/198; 226/171

[58] Field of Search ..... 400/605, 625, 636, 55, 400/56, 58, 619; 271/8.1, 10, 4, 226, 229, 198; 226/198, 171, 174

[56] References Cited

U.S. PATENT DOCUMENTS

| | | | |
|---|---|---|---|
| 2,528,420 | 10/1950 | Carroll et al. . | |
| 2,657,601 | 11/1953 | Bentley . | |
| 2,973,957 | 3/1961 | Busch | 226/198 |
| 3,352,470 | 11/1967 | Powers | 226/91 |
| 3,411,686 | 11/1968 | Bender . | |
| 3,417,907 | 12/1968 | Westbury . | |
| 3,556,512 | 1/1971 | Fackler | 271/50 |
| 3,664,481 | 5/1972 | Drelmanis et al. | 400/636 |
| 3,907,284 | 9/1975 | Fritz | 217/273 |
| 4,197,025 | 4/1980 | Kiielzer | 400/647.1 |
| 4,622,718 | 12/1986 | Wyer | 355/35 |
| 4,669,721 | 6/1987 | Westover | 217/272 |
| 4,671,686 | 6/1987 | Howes et al. | 400/605 |
| 4,763,575 | 8/1988 | Miciukiewicz | 400/56 |
| 4,821,049 | 4/1989 | Eckl | 346/134 |
| 4,842,263 | 6/1989 | Robertson | 271/186 |
| 4,903,954 | 2/1990 | Robertson et al. | 217/7 |
| 4,995,745 | 2/1991 | Yokoi et al. | 400/605 |
| 4,995,746 | 2/1991 | Rosenthal | 400/616.2 |
| 4,997,179 | 3/1991 | Mizutani et al. | 400/625 |
| 5,000,591 | 3/1991 | Burgess | 400/56 |
| 5,000,598 | 3/1991 | Jingu et al. | 400/642 |
| 5,005,746 | 4/1991 | Murakami et al. | 226/101 |
| 5,026,184 | 6/1991 | Dürr et al. | 400/605 |
| 5,030,024 | 7/1991 | Seshimo | 400/605 |
| 5,030,025 | 7/1991 | Mitcham et al. | 400/636 |
| 5,039,086 | 8/1991 | Matsuno et al. | 271/227 |
| 5,059,049 | 10/1991 | Rosenthal | 400/605 |
| 5,066,984 | 11/1991 | Coombs | 400/619 |
| 5,118,208 | 6/1992 | Kitahara | 400/56 |
| 5,123,761 | 6/1992 | Rosenthal | 400/605 |
| 5,135,315 | 8/1992 | Kitahara | 400/56 |

FOREIGN PATENT DOCUMENTS

| | | | |
|---|---|---|---|
| 0143162 | 6/1986 | Japan | 400/636 |
| 1172157 | 7/1989 | Japan . | |

*Primary Examiner*—Eugene H. Eickholt
*Attorney, Agent, or Firm*—Michael E. Belk

[57] ABSTRACT

A printing device has paper feed devices upstream and downstream of a printing station. The downstream paper feed devices uses pairs of pressure feed rolls which frictionally feed the paper when received. A tapered guide channel positioned in side by side relation with the pair of feed rolls comprises a stationary guide plate and pivotable guide plate with guide surfaces designed to collapse any curl in the leading edge of single or multilayer paper. A spring maintains the pivoted guide plate in operating position with a predetermined spring force which opposes deflection by the leading edge of the paper but allow deflection due to paper generated forces exceeding the predetermined spring force.

9 Claims, 4 Drawing Sheets

GUIDE SYSTEM FOR FEED ROLL ENTRY

FIELD OF INVENTION

This invention relates to print media feeding and particularly to a paper guide system in a printer for accurately guiding the leading edge of fan folded paper being fed past a print station into engagement with a pair of pressure feed rolls. While not necessarily limited thereto, the invention has particular utility in serial dot matrix printers.

BACKGROUND OF THE INVENTION

In printers, fan folded paper is commonly fed by paper moving devices located on opposite sides of a print station which in a dot matrix printer commonly comprises a horizontal bar platen and a traversing print head. The paper moving device on the upstream side of the print station often comprises pin feed devices such as pin belt tractors which engage perforations along opposite edges of the paper. The paper moving device on the downstream side is usually a friction feed device comprised of one or more pairs of cooperating pressure feed rolls. The paper feeding devices are operated in a coordinated manner by a common drive mechanism for feeding the paper in a substantially straight line path in forward and reverse directions across the platen and through the print station. Among other things the use of dual paper moving devices enables the paper, which can be either single or multiple layers, to be tensioned for printing. A tear structure may also be provided downstream from the feed rolls to allow, portions of the paper to be separated from the printer. Examples of printers with such paper feeding, are the IBM 4224 Printer and the IBM 4230 Printer. Other examples of dual feed devices of the above type are shown in U.S. Pat. Nos. 5,030,025; 5,005,746; 4,995,745 and 4,671,686, the latter describing the dual feed devices as parts of a paper feed module or assembly which can be removed from, and installed onto the frame of a printer. The printer frame contains the platen, the print mechanism and the power drive system along with electrical controls for operating the print mechanism and the power drive system.

In order to realize the maximum utilization of the paper, the leading edge margin should be as small as possible, i.e. the first print line should be as close as practicable to the leading edge of the paper. It has been found, however, that printing close to the, leading edge of certain grades of paper tends to cause the leading edge to curl or to spread in the case of multi-layer paper. Consequently, the leading edge of the paper, unless constrained as it is moved beyond the print station toward the feed rolls, will be misaligned and will not enter the feed rolls properly so that the paper jams or is damaged. Curling or spreading of the leading edge of the paper also occurs when the paper is torn off at the tear structure. Thus, the same problem of misalignment and paper jamming results when the paper, in order to print near the leading edge, is then reverse fed to the extent that the leading edge is no longer held within the feed rolls.

One possible approach to solving the problem would be to provide means for separating the feed rolls until the paper is within the pinch point or bite of the rolls. Another approach might be to use paper which is sufficiently stiff so that curling or spreading is minimal or non-existent. Both approaches have obvious limitations.

A further approach is to provide a paper guide structure between the print station and the feed rolls. Heretofore, one type of guide structure consists of stationary guide plates arranged to form a channel or chute extending between successive pairs of feed rolls or between a rotating platen and a pair of feed rolls. Such structures have been primarily designed for single sheet feeding and are not easily adjusted to accommodate paper having different layers. Another type paper guide structure consists of one or more stationery guide plates extending through and in either direction beyond the print station and includes springs or spring loaded pressure rolls or belts which press the paper against a surface of the guide plate. Besides being unduly complex, such structures place limitations on the design and servicing of the printer and paper feed devices. Sheet feeding devices are known which use mechanisms for removing curl from the sheet to improve stacking. None have dealt with the problem of leading edge curling or spreading of single or multilayer papers.

Examples of various types of guide structures may be seen in U.S. Pat. Nos. 2,528,420; 2,973,957; 3,352,470; 3,556,512; 4,197,025; 4,669,721; 4,842,263; 4,903,954; 4,995,745; 4,995,746; 4,997,179; 5,000,598; and 5,030,024. U.S. Pat. No. 5,078,525 deals with the problem of distortion across the center section of the leading edge of a document being fed by pin feed tractors into the entry structure of a printer. The problem is solved by providing an entry plate with different entry slope angles to guide different parts of the distorted leading edge of the paper into the entry. None of these references is suitable for solving the leading edge curling/-flaring problem when paper is being fed into feed rolls.

SUMMARY OF THE INVENTION

Basically, the invention solves the problem by providing the print media feeding apparatus of a printer with a media guide structure designed to direct the unsupported leading edge of the media as it is advanced past the print station toward the nip region of feed rolls without requiring the feed rolls to be opened and closed. In addition, a guide structure is provided which allows the media to be reverse fed even to the extent that the leading edge can become disengaged from the feed rolls so that printing can occur very close to the leading edge of the print media.

The guide structure according to the invention comprises a tapered paper guide channel having stationary and pivotable guide plates positioned in side by side relation with the pairs of feed rolls. The pivotable guide plate has a guide surface slanted toward a guide surface of the stationary guide plate. A coil spring maintains the pivotable guide plate in an operating position with a predetermined spring force which opposes deflection of the pivotable guide plate to cause any curl or spread in the leading edge of single or multilayer paper to be collapsed as it approaches the feed rolls. The predetermined spring force allows the pivotable guide plate to be deflected if paper generated forces exceed the predetermined spring force. This prevents paper jamming in the guide channel where an outfold or other condition may occur. The position of the guide channel in side by side relation to the feed rolls requires less space and provides a more compact design.

Other objects, features and advantages of the invention will become readily apparent from the following particular description of a specific embodiment of the invention as illustrated in the accompanying drawings.

DETAILED DESCRIPTION OF THE INVENTION

Figure 1:
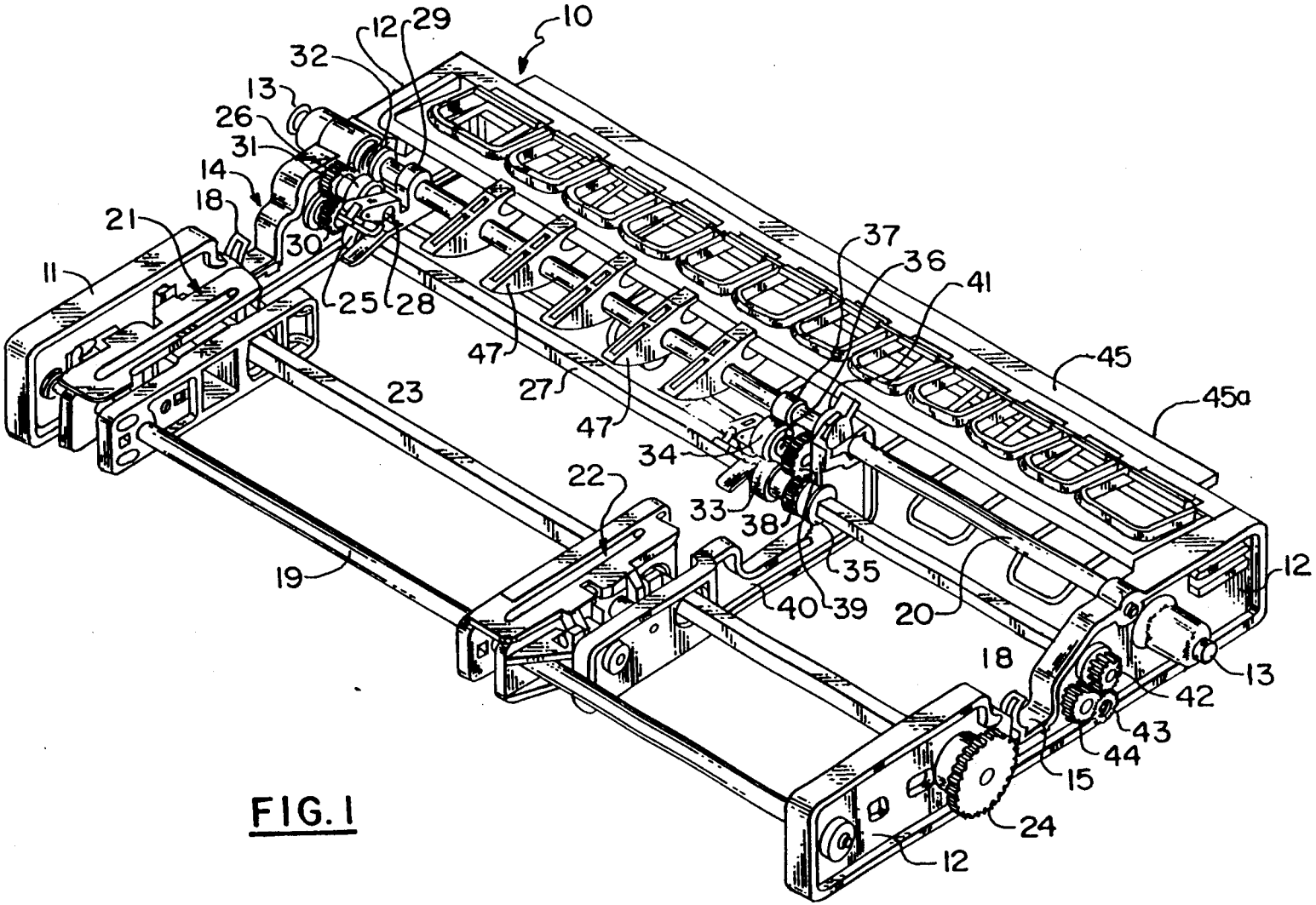
FIG. 1 is an isometric view of a paper feed device which incorporates the invention.
Figure 2:
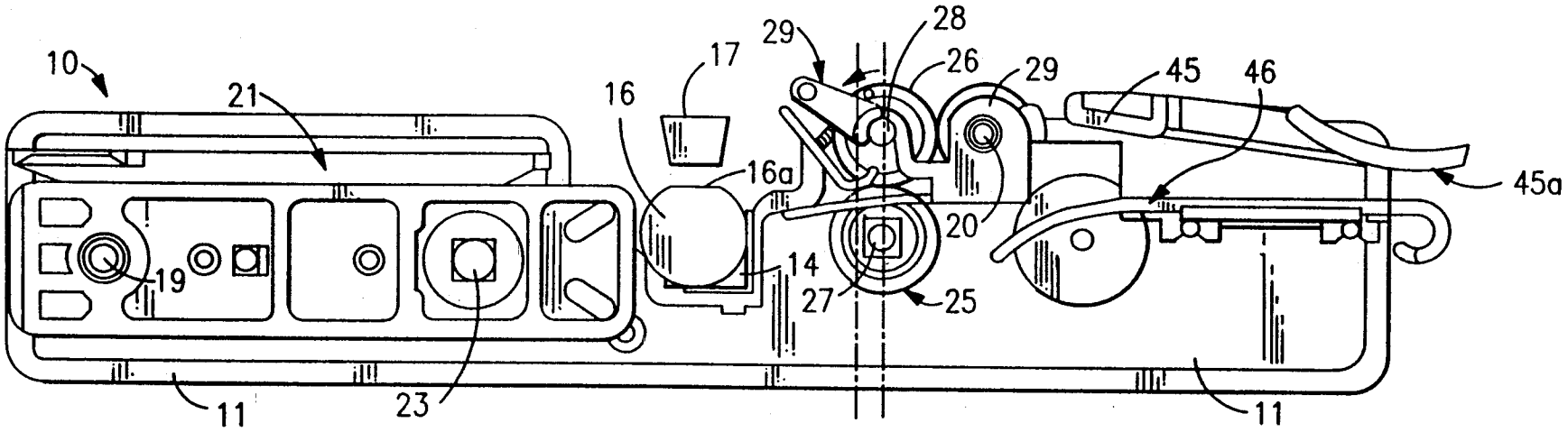
FIG. 2 is a side elevational view of the paper feed device of FIG. 1.

Referring to FIGS. 1 and 2, a feed mechanism module 10 is shown similar to the paper feed module of the aforementioned U.S. Pat. No. 4,671,686. As shown, module 10 comprises parallel side plates 11 and 12 with outwardly extending mounting pins 13 designed for installing module 10 into a printer unit as more fully shown and described in said U.S. Pat. No. 4,671,686. Notch means 14 and 15 are provided in the upper edges of side plates 11 and 12 respectively for receiving the platen 16 which along with print mechanism 17 form the printing station of the printer unit. Platen 16 is essentially a cylindrical rod with a milled flat 16*a* which serves as a printing surface over which the paper passes. Print mechanism 17 is preferably a wire matrix print head movable by a carriage mechanism across the width of paper which overlays milled flat 16*a* of platen 16. Clamping means in the form of wire clips 18 are provided for clamping module 10 to the platen 16. Shaft means 19 and 20, which also serve as support shafts for paper moving device, are fixed at opposite ends to maintain side plates 11 and 12 in a spaced apart relationship.

In accordance with the invention, first and second paper feed means are mounted on module 10 on opposite sides of notches 14 and 15. Thus when module 10 is installed, the first and second feed means are located on opposite, i.e. the upstream and downstream, sides of the printing station which includes platen 16 and print mechanism 17. In the preferred manner of practicing the invention, the first paper feed means located on the upstream side of the printing station comprises pin feed tractors 21 and 22 mounted on support shaft 19 and drive shaft 23, the latter being rotatably supported between side plates 11 and 12. Tractors 21 and 22 are well known pin feed tractors of the type conventionally having an endless pin belt with pin elements which engage perforations along the edge margin of continuous fan folded single or multilayer paper. Tractor 21 is attached to support shaft 19 near side plate 11 and and has a fixed lateral position. Tractor 22 is manually slidable along support shaft 19 and drive shaft 23 to various lateral positions in order to accommodate paper having different widths for printing. Tractors 21 and 22 are driven in a well known manner through a drive gear 24 fixed on the end of drive shaft 23 and which engages a power drive on the printer when module 10 is installed in the printer unit.

The second paper feed means, located on the downstream side of the printing station, comprises two pairs of cooperating feed rolls designed to be operated in a coordinated manner with tractors 21 and 22 for joint and individual feeding of paper relative to the printing station of the printer. The first pair of cooperating feed rolls comprises feed rolls 25 and 26. Feed roll 25 is attached to drive shaft 27 which is rotatably supported by side plates 11 and 12. Feed roll 26 is attached to stub shaft 28 which is rotatably supported by bracket member 29 which is pivotable on support shaft 20. The drive means for feed rolls 25 and 26 comprise gears 30 and 31 attached respectively to drive shaft 27 and stub shaft 28 between feed rolls 25 and 26 and side plate 11. A coil spring 32 connected to bracket member 29 and side plate 11 applies a spring force which biases the pivoted bracket member 29 and assembled parts so that the peripheries of feed rolls 25 and 26 are maintained in contact at a pinch point and with any paper located therebetween. The lateral position of feed rolls 25 and 26 respectively on drive shaft 27 and support shaft 20 is fixed so that they are aligned with the pin feed belt of tractor 21. Thus the feed rolls 25 and 26 engage the paper along the edge margin containing the perforations. The feed rolls 25 and 26 and drive gears 30 and 31 are disengageable by manual rotation of bracket member 29 against the bias of spring 32.

In accordance with the preferred embodiment of the invention, the second paper feed means comprises a second pair of cooperating feed rolls 33 and 34. Feed roll 33 is attached to a sleeve 35 which is slidably supported on drive shaft 27. Feed roll 34 is attached to stub shaft 36 rotatably supported by bracket member 37 which is pivotably and slidably supported on support shaft 20. Feed rolls 33 and 34 are driven by drive gears 38 and 39 respectively. Drive gear 38 is attached to sleeve 35 so that it is slidable jointly along drive shaft 27 with feed roll 33 while drive gear 39 is fixed to stub shaft 36. An adjustment bracket 40 is connected at one end to tractor 22 and at the other end is slidably supported by support shaft 20 and is connected to bracket member 37. Thus the feed rolls 33 and 34 are maintained in alignment with the pin belt of tractor 22 and feed rolls 33 and 34 are laterally adjustable with tractor 22 to accommodate use of papers of different widths. The alignment of feed rolls 33 and 34 with the pin belt of tractor 22 enables the feed rolls to engage the perforated edge margin of the paper. Coil spring 41 (similar to 32 but hidden by bracket 40) is connected to adjustment bracket 40 and bracket member 37 and applies a bias force to bracket member 37 so that the peripheries of feed rolls 33 and 34 are maintained in contact at a pinch point and press the paper located therebetween and the drive gears 38 and 39 are maintained in engagement. Feed rolls 33 and 34 are separatable and drive gears 38 and 39 are disengageable by manually rotating bracket member 37 upward against the bias of coil spring 41. The drive mechanism for rotating the feed rolls 25, 26, 33 and 34 further includes drive gear 42 on the end of drive shaft 27 and transmission gears 43 and 44 which are enageable with a driver member on the printer unit when module 10 is installed. While various drive mechanisms can be used to operate the tractors and the feed rolls to feed paper, the gear combinations and connections are such that a single power source drives the tractors at different coordinated speeds in either forward or reverse direction and that the feed rolls feed paper at a slightly faster linear speed in order to maintain the paper in tension for printing at the printing station. For this reason, the feed rolls are made of friction material and the paper is fed or maintained in tension by frictional engagement of the feed roll peripheries and the opposite surfaces of the paper. The mechanisms and materials for achieving this are well known in the prior art including art previously referred to herein.

Also included in feed module 10 are output paper guide plates 45 and 46 located downstream from feed rolls 25, 26, 33 and 34. The edge 45*a* of guide plate 45 serves as a tear edge for tearing sections of paper from a continuous fan folded print paper. A plurality of paper guide elements 47 are arranged along support shaft 20 engage the top surface of the paper as it moves through the pairs of feed rolls to suppress side to side blousing of the paper. Guide elements 47 may be individually slidable along support shaft 20 to permit manual adjustment for papers of different widths.

Figure 4:
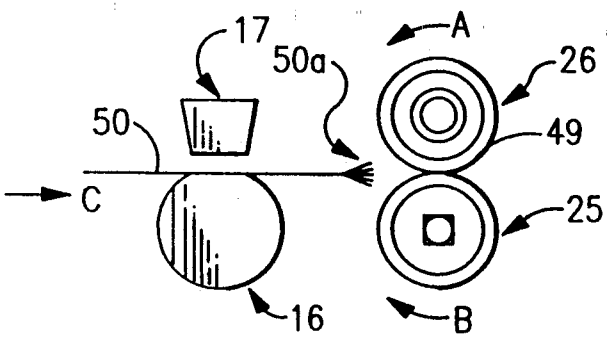
FIG. 4 is a schematic of a feed device illustrating the problem of feeding multiple layer paper with spread leading edges into a pair of feed rolls.
Figure 3:
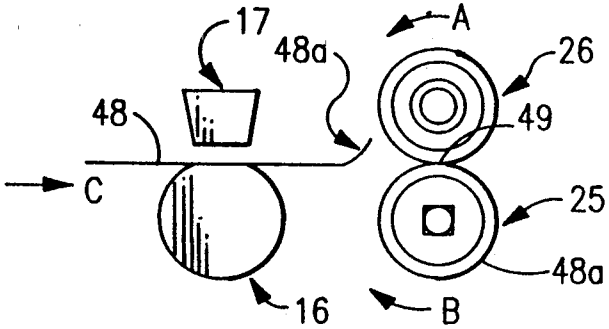
FIG. 3 is a schematic of a feed device for illustrating the problem of feeding single layer paper with a curled leading edge into a pair of feed rolls.
Figure 7:
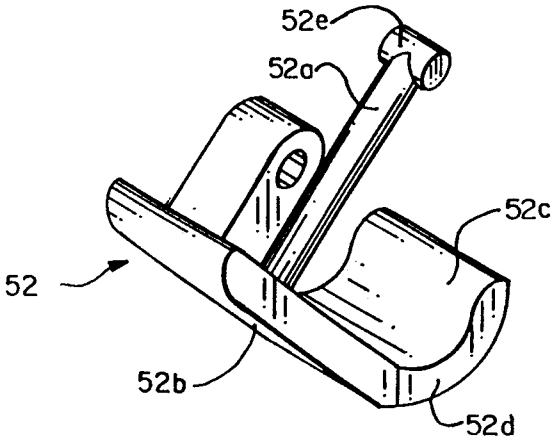
FIGS. 7 and 8 are isometric drawings of the pivotable guide plate portion of the channel guide of the preceding figure.
Figure 8:
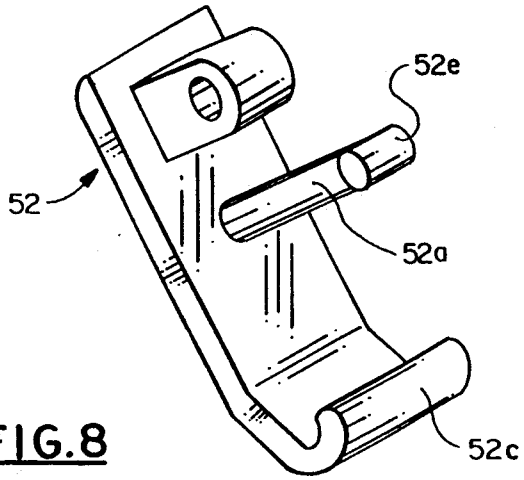
Figure 6:
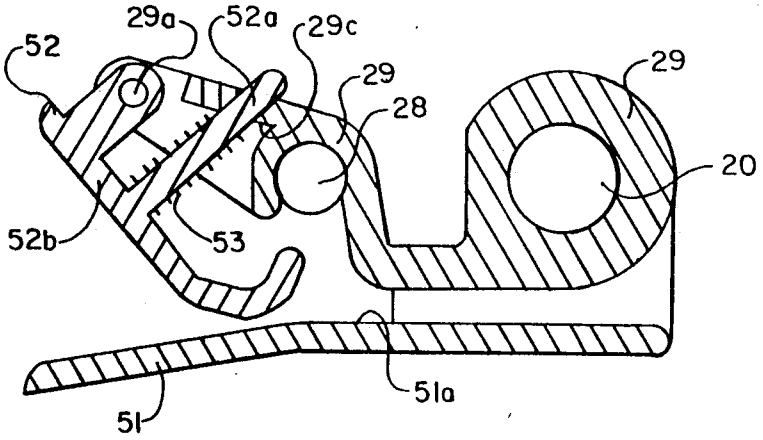
FIG. 6 is a cross section of the channel guide and bracket member of FIGS. 1 and 2.

In the preferred manner in which this invention is practiced, paper is fed by tractors 21 and 22 along a straight feed path leading over the milled flat 16*a* of platen 16 and beyond to feed rolls 24, 25, 33 and 34. After leaving the printing station, the leading edge of the paper is essentially unsupported as it approaches the feed rolls. As a consequence, the curled leading edge of the paper diverges from the desired feed path leading into the feed rolls. In the course of being transported along the feed path, the paper is advanced incrementally one or more line increments by tractors 21 and 22. As is customary, each incremental advance may be followed by a printing operation. The initial print line desirably is located close the leading edge of the paper. As previously mentioned, such printing causes curling or spreading of the leading edge of the paper. The problem is illustrated in FIG. 3 for a single pair of feed rolls where single layer paper 48 has a curled edge 48*a*. It is readily apparent that curled edge 48*a* has deviated upwardly from the desired feed path leading into the pinch point 49 of feed rolls 25 and 26. In spite of the fact that feed rolls 25 and 26 are made of high friction material and are counterrotating as shown by direction arrows A and B, the friction force may not be sufficient to uncurl leading edge 48*a* enough to avoid reverse folding or damage as paper 48 moves in direction C. This is especially true if paper 48 is advanced relatively rapidly over a distance of several line increments. FIG. 4 shows the problem as it applies to multilayer paper 50 where the leading edges 50*a* of the various layers are spread so that they deviate both above and below the desired feed path leading to pinch point 49. Again the friction forces of the counter rotating feed rolls 25 and 26 may be insufficient to bring the leading edges 50*a* together and backfolding or damage to the various layers of paper 50 may occur.

In accordance with the invention, the paper feed module is provided with a tapered paper guide channel located in side by side relation with the feed rolls so that the curl or spread of the leading edges of single or multilayer paper is collapsed as the paper is advanced toward and into the pairs of feed rolls. For the purpose of illustrating the details of the invention, only a guide channel and pair of feed rolls is shown, it being understood that the other guide channel and second pair of feed rolls is identical in all respects. As seen in the figures and particularly FIGS. 5–10, the tapered channel for feed rolls 25 and 26 comprises a stationary lower guide plate 51 and pivoted guide plate 52 both supported by bracket member 29. In the preferred manner in which the invention is practiced, plate 51 is an integral part of bracket member 29. Guide plate 52 is pivotally connected by pin 29*a* to arm 29*b* of bracket member 29 which also rotatably supports stub shaft 28 and its feed roll 26. A post 52*a* on the back of pivotable guide plate 52 extends through aperture 29*c* in arm 29*b* of bracket member 29. Coil spring 53 on post 52*a* is compressed between arm 29*b* and pivoted guide plate 52 so that a predetermined biasing force is applied to guide plate 52 for the purpose of opposing deflection by the leading edge of paper transported toward the feed rolls. The predetermined spring force is sufficient to collapse any curl or spread in the leading edge of the paper but will allow deflection of guide plate 52 if a paper generated force exceeds the predetermined spring force. Such a condition can occur when the paper is fed at high acceleration levels or when an outfold engages the guide plate 52. The conditions are particularly likely to occur where multilayer paper is used.

As shown in the various figures, the stationary guide plate 51 has a guide surface 51*a* in the vicinity of the feed rolls 25 and 26 for supporting paper as it approaches and moves through the feed rolls. Pivoted plate member 52 has a guide surface 52*b* opposite and slanted at an acute angle toward guide surface 51*a*. In order to accommodate paper of different layers, guide surface 51*a* is slightly below the plane 54 (see FIG. 5) tangent to the feed rolls at the pinch point. The portion of guide surface 51*a* extending forwardly of the pinch point is also slanted downwardly at a slight angle from the tangent plane. The portion of guide surface 51*a* extending rearwardly from the pinch point is essentially parallel with the tangent plane 54.

Guide surface 52*b* of guide plate 52 is positioned in advance of feed rolls 25 and 26 and is slanted at an acute angle which intersects the periphery of feed roll 25 at a point in advance of the pinch point of the feed rolls. Thus when the leading edge of the paper comes into engagement with the periphery of feed roll 25, it is drawn by the feed roll 25 into the pinch point for subsequent feeding by the feed rolls. Guide plate 52 terminates in a reversely curled end portion 52*c* with a curved guide surface 52*d* which is an extension of guide surface 52*b*. A stop knob 52*e* on the end of post 52*a* is maintained against arm 29*b* by the compressed coil spring 53 for the purpose of maintaining guide surface 52*b* at the desired angle and operating position for deflecting the leading edge of the paper. In this manner, the biasing force of spring 53 is set at a predetermined level which opposes deflection of guide plate 52 so that the leading edge of paper is collapsed as it engages guide surfaces 52*b* and 52*d* and moves toward contact with the periphery of feed roll 25.

Figure 5:
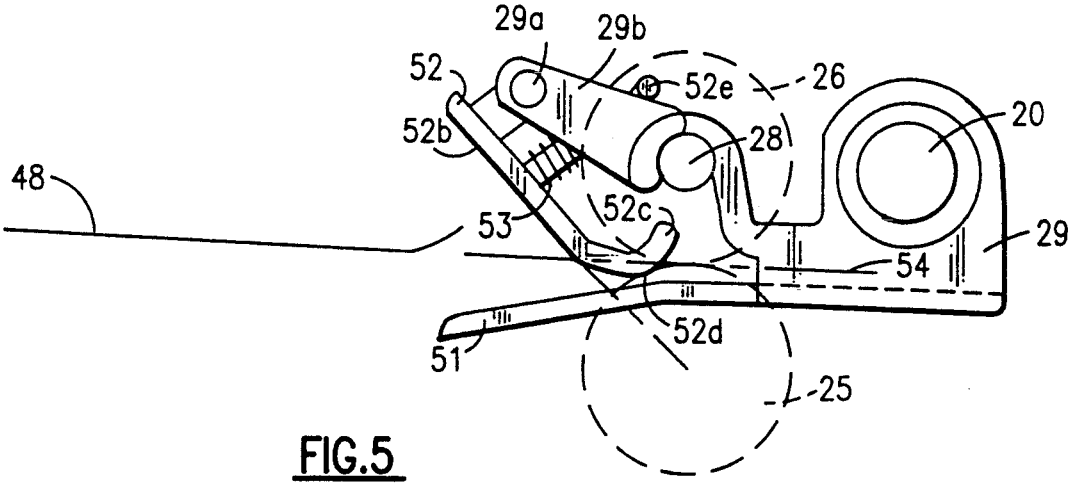
FIG. 5 is a side elevational view of a portion of the paper feed device of FIG. 2.
Figure 9:
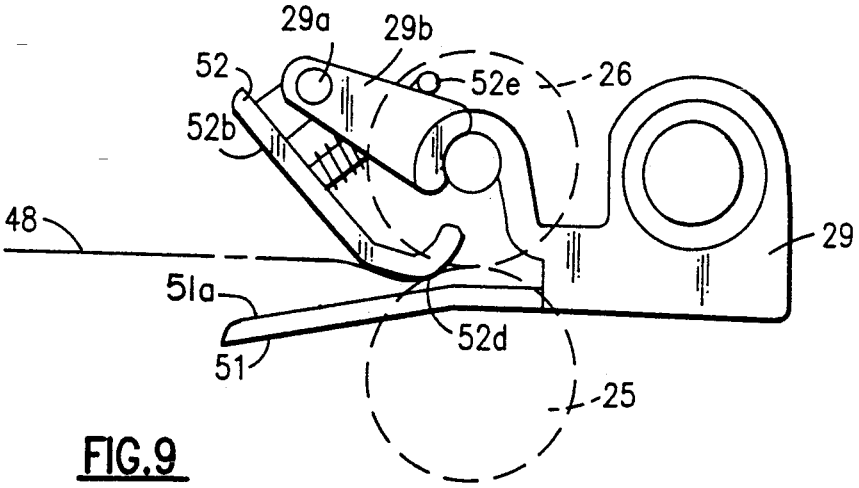
FIGS. 9 and 10 are side elevational view of one of the pairs of feed rolls and channel guides which along with FIG. 5 show the paper feed sequence as it moves into the channel guide and feed rolls in accordance with the invention.
Figure 10:
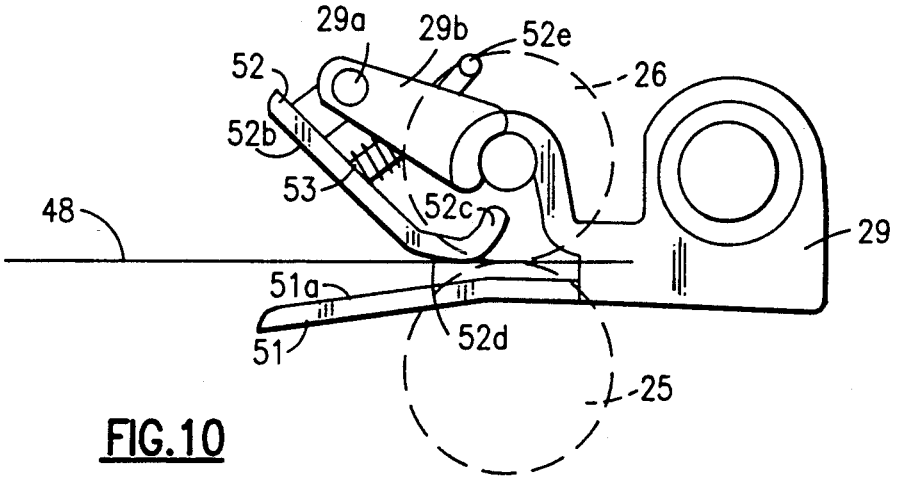

The guidance of paper and collapse of the curl in the leading edge of the paper is illustrated in FIGS. 5, 9 and 10. FIG. 10 shows the pivoted guide plate 52 being deflected by a deflection force greater than the spring preload force from coil 53. This prevents the paper from jamming in the guide channel.

From the above it will be seen that an improved paper feed device for a printer is provided that is capable of eliminating curl in the leading edge of paper being fed into a pair of pressure type feed rolls. Also by locating the guide channel in side by side relation with the feed rolls, the distance the unsupported edge of the paper must travel after passing through the printing station is considerably lessened so that the feed mechanism can be made more compact.

While the invention has been particularly shown and described with reference to a preferred embodiment and a preferred application thereof, it will be understood by persons skilled in the art that changes in form and detail may be made therein without departing from the spririt and scope of the invention as defined in the appended claims.

We claim:

1. A printer comprising in combination:

a printing station, paper moving devices positioned in the direction of paper travel on opposite sides of said printing station for feeding single or multilayer paper through said printing station, said paper moving devices including at least one pair of cooperating friction feed rolls on one side of said print station for receiving the leading edge of paper advancing from said print station, said feed rolls having peripheries in contact at a pinch point for engaging said paper, and paper guide channel means in side by side relation with said feed rolls for guiding the leading edge of said single or multilayer paper into said feed rolls, comprising:

a stationary plate member providing a first guide surface for supporting said paper in the vicinity of said feed rolls, a movable plate member providing a second guide surface opposite said first guide surface, said second guide surface being slanted at an angle with relation to said first guide surface to form a tapered guide channel with said first guide surface which leads to a narrowest point at about the pinch point of said feed rolls, said movable plate member having an operating position in which said guide surfaces engage the leading edge of said single or multilayer paper in advance of said feed rolls for directing said leading edge of said paper toward said pinch point of said feed rolls, and spring means connected to said movable plate member for maintaining said movable plate member in said operating position when no paper is between the plate members, with a predetermined force sufficient to collapse any curl or separation in the leading edge of said paper as said leading edge of said paper engages the periphery of said feed rolls, and for resisting deflecting the movable plate from said operating position in response to a paper generated force exceeding said predetermined force.

2. A printing device in accordance with claim 1 in which:

said paper moving devices comprise tractor means located upstream from said printing station and said feed rolls, said tractor means, said printing station and said feed rolls being arranged along a substantially straight paper feed path, and further including, drive means for operating said tractor means to transport said single or multilayer paper along said feed path through said printing station and into engagement with said guide channel means and said feed rolls.

3. A printing device in accordance with claim 2 in which said paper moving devices comprise tractor means located upstream from said printing station and said feed rolls, said printing station comprises a platen and a cooperating print mechanism, said tractor means and said feed rolls are elements of a paper feed module assembly mountable in said printer whereby said platen and print mechanism are located between said tractor means and said feed rolls, and further including, drive means for operating said tractor means to transport said single or multilayer paper along said feed path through said printing station and into engagement with said guide channel means and said feed rolls.

4. A printing device in accordance with claim 1 in which:

said single and multilayer paper includes perforations along an edge thereof, said paper moving devices include pin tractor means for engaging said perforations for feeding said paper through said print station and toward said feed rolls, said feed rolls being aligned with said pin tractor means for engaging said leading edge of said paper in alignment with said perforations, and said stationary plate member and said movable plate member are engageable with said leading edge of said paper inside the perforations of said paper.

5. A printing device in accordance with claim 1 in which:

said single or multilayer paper is fan folded paper, and said paper generated force is the result of an outfold in said paper.

6. A paper feed device comprising in combination:

a pair of feed rolls for feeding single or multilayer paper, said feed rolls having peripheries in contact at a pinch point, a paper guide element taking the form of a moveable guide plate having a guide surface arranged ahead of and in side by side relationship with said feed rolls, said guide surface being slanted in the direction of said feed rolls and across a plane defining a paper feed path through the pinch point of said feed rolls, and a spring member connected to said guide element for yieldably maintaining said guide surface in position across said plane for engaging said leading edge of said paper being fed toward said rolls, and for collapsing any curl or spread in the leading edge of said single or multilayer paper as said leading edge engages said peripheries of said feed rolls at about said pinch point, and for permitting deflecting said movable guide plate from said position across said plane in response to a paper generated deflection force.

7. A paper feed mechanism for feeding single or multilayer paper in a printer comprising in combination:

a pair of cooperating feed rolls with peripheries in contact at a pinch point, and a guide channel in side by side relation with said feed rolls for guiding the leading edge of said single or multilayer paper toward said feed rolls comprising a stationary plate member providing a first guide surface for supporting paper in the vicinity of said feed rolls, a movable guide plate providing a second guide surface in advance of said feed rolls which is slanted in relation to the first guide surface, toward said first guide surface and said feed roll pinch point, said second guide plate having an operating position in which said second guide surface engages the leading edge of said paper in advance of said feed rolls and directs said leading edge of said paper toward the periphery of said feed rolls in advance of said pinch point, and spring means connected to said moveable guide plate for yieldably maintaining said movable guide plate at said operating position for collapsing any curl or separation in the leading edge of said paper until said leading edge of said paper engages the periphery of said feed rolls, and for permitting a paper generated force to deflect the moveable guide plate and the paper away from said stationary guide plate in response to a force generated by the feed rolls.

8. A device for feeding single or multilayer print media in a printer having a printing station, comprising in combination:

first feed means on one side of said printing station for advancing said print media past said printing station, second feed means comprising a pair of cooperating feed rolls on the other side of said printing station for receiving said leading edge of said print media when advanced by said first feed means past said printing station, said feed rolls having peripheries in contact at a pinch point, and guide means in side by side relation with said feed rolls for directing the leading edge of said print media toward said feed rolls, comprising:

a movable member having a guide surface positioned for engagement by said leading edge of said print media in advance of said feed rolls as said print media is advanced past said printing station by said first feed means, said guide surface being slanted toward said feed rolls, said movable member being deflectable in response to engagement of said guide surface by said leading edge and the advancement of said print media by said first feed means, and spring means connected to said movable member for yieldably opposing the deflection of said movable member by said leading edge of said print media with a predetermined spring force sufficient to collapse any curl or separation in said leading edge of said print media between the guide surface and the peripheral surface of the feed rolls at a point in advance of said pinch point.

9. A printer comprising in combination:

a printing station, paper moving devices positioned in the direction of paper travel on opposite sides of said printing station for feeding single or multilayer paper through said printing station, said paper moving devices including at least one pair of cooperating friction feed rolls on one side of said print station for receiving the leading edge of paper advancing from said print station, said feed rolls having peripheries in contact at a pinch point for engaging said paper, and paper guide channel means in side by side relation with said feed rolls for guiding the leading edge of said single or multilayer paper into said feed rolls, comprising:

a stationary plate member providing a first guide surface for supporting said paper in the vicinity of said feed rolls, a movable plate member providing a second guide surface opposite said first guide surface, said second guide surface being slanted at an angle with relation to said first guide surface to form a tapered guide channel with said first guide surface which leads to said feed rolls, said movable plate member having an cooperating position in which said guide surfaces engage the leading edge of said single or multilayer paper in advance of said feed rolls for directing said leading edge of said paper toward said pinch point of said feed rolls, and spring means connected to said movable plate member for maintaining said movable plate member in said operating position about in contact with the fixed plate when no paper is between the plate members, with a predetermined force sufficient to collapse any curl or separation in the leading edge of said paper as said leading edge of said paper engages the periphery of said feed rolls, and for permitting deflecting the movable plate and said paper ways form said fixed plate in response to a force of the paper against the movable plate generated by stretching the paper between the paper moving devices.

* * * * *